US006886510B2

(12) United States Patent
Sun et al.

(10) Patent No.: US 6,886,510 B2
(45) Date of Patent: May 3, 2005

(54) ENGINE VALVE ACTUATOR ASSEMBLY WITH DUAL HYDRAULIC FEEDBACK

(75) Inventors: Zongxuan Sun, Troy, MI (US); Norman Kenneth Bucknor, Troy, MI (US)

(73) Assignee: General Motors Corporation, Detroit, MI (US)

( * ) Notice: Subject to any disclaimer, the term of this patent is extended or adjusted under 35 U.S.C. 154(b) by 111 days.

(21) Appl. No.: 10/405,995

(22) Filed: Apr. 2, 2003

(65) Prior Publication Data

US 2004/0194743 A1 Oct. 7, 2004

(51) Int. Cl.[7] ..... F01L 9/02

(52) U.S. Cl. ..... 123/90.12; 123/90.11; 123/90.15; 91/318

(58) Field of Search ..... 123/90.12, 90.11, 123/90.15; 91/318

(56) References Cited

U.S. PATENT DOCUMENTS

| | | | | |
|---|---|---|---|---|
| 1,703,858 A | | 3/1929 | Banner | |
| 3,157,166 A | | 11/1964 | MacNeill | |
| 4,009,695 A | | 3/1977 | Ule | |
| 4,044,652 A | | 8/1977 | Lewis et al. | |
| 4,459,946 A | | 7/1984 | Burandt | |
| 4,807,517 A | | 2/1989 | Daeschner | |
| 5,373,818 A | | 12/1994 | Unger | |
| 5,421,545 A | | 6/1995 | Schexnayder | |
| 5,546,222 A | | 8/1996 | Plaessmann et al. | |
| 5,572,961 A | | 11/1996 | Schechter et al. | |
| 5,638,781 A | | 6/1997 | Sturman | |
| 5,881,689 A | * | 3/1999 | Hochholzer | 123/90.12 |
| 6,109,284 A | | 8/2000 | Johnson et al. | |
| 6,112,711 A | | 9/2000 | Shimizu et al. | |
| 6,263,842 B1 | | 7/2001 | DeOjeda et al. | |
| 6,374,784 B1 | | 4/2002 | Tischer et al. | |
| 6,505,584 B2 | | 1/2003 | Lou | |
| 6,688,267 B1 | | 2/2004 | Raghavan | |
| 6,739,293 B2 | * | 5/2004 | Turner et al. | 123/90.12 |
| 2003/0015155 A1 | | 1/2003 | Turner et al. | |
| 2003/0172885 A1 | | 9/2003 | Gaessler et al. | |

* cited by examiner

*Primary Examiner*—Thomas Denion
*Assistant Examiner*—Zelalem Eshete
(74) *Attorney, Agent, or Firm*—Kathryn A. Marra

(57) ABSTRACT

A valve actuator assembly for an engine includes a movable engine valve and a movable spool valve. The valve actuator assembly also includes a driving channel interconnecting the spool valve and the engine valve and a first feedback channel and a second feedback channel interconnecting the spool valve and the engine valve. The valve actuator assembly includes an actuator operatively cooperating with the spool valve to position the spool valve to prevent and allow fluid flow in and out of the driving channel to position the engine valve. The valve actuator assembly further includes a first on/off valve and a second on/off valve in fluid communication with the first feedback channel and the second feedback channel to enable and disable the first feedback channel and the second feedback channel, whereby the first on/off valve and the second on/off valve control motion of the spool valve.

22 Claims, 4 Drawing Sheets

ENGINE VALVE ACTUATOR ASSEMBLY WITH DUAL HYDRAULIC FEEDBACK

TECHNICAL FIELD

The present invention relates generally to intake or exhaust valve actuators for engines and, more particularly, to a valve actuator assembly with dual hydraulic feedback for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having one or more cams, and a tappet contacting each cam and valve. Typically, engine valve actuation is accomplished via the engine-driven camshaft. However, this type of valve actuation introduces constraints on valve operation that preclude optimal valve opening and closing schedules, compromising engine performance, fuel economy, and emissions.

It is also known to provide a camless valve train for an internal combustion engine. An example of such a camless valve train is disclosed in the prior art. For example, a camless intake/exhaust valve for an internal combustion engine is controlled by a solenoid actuated fluid control valve. The control valve has a pair of solenoids that move a spool. The solenoids are digitally latched by short digital pulses provided by a microcontroller.

One disadvantage of some camless valve trains is their poor controllability due to open loop instability, which causes great difficulty in their operation. Another disadvantage of some camless valve trains is that they do not provide full capability for variable lift. Further disadvantages of some camless valve trains are that they have relatively high cost, large size, high energy consumption, low repeatability from cycle to cycle and cylinder to cylinder, hard seating impact, and high seating velocity induced noise.

As a result, it is desirable to provide a valve actuator assembly for an engine that improves controllability. It is also desirable to provide a valve actuator assembly for an engine having more flexibility and full capacity for variable lift. It is further desirable to provide a valve actuator assembly for an engine that reduces energy consumption and provides satisfactory seating velocity. Therefore, there is a need in the art to provide a valve actuator assembly for an engine that meets these desires.

SUMMARY OF THE INVENTION

It is, therefore, one object of the present invention to provide a new camless valve actuator assembly for an engine.

It is another object of the present invention to provide a valve actuator assembly for an engine that has dual hydraulic feedback for controllability.

To achieve the foregoing objects, the present invention is a valve actuator assembly for an engine. The valve actuator assembly includes a movable engine valve and a movable spool valve. The valve actuator assembly also includes a driving channel interconnecting the spool valve and the engine valve, a first feedback channel interconnecting the spool valve and the engine valve, and a second feedback channel interconnecting the spool valve and the engine valve. The valve actuator assembly includes an actuator operatively cooperating with the spool valve to position the spool valve to prevent and allow fluid flow in and out of the driving channel to position the engine valve. The valve actuator assembly further includes a first on/off valve in fluid communication with the first feedback channel to enable and disable the first feedback channel. The valve actuator assembly also includes a second on/off valve in fluid communication with the second feedback channel to enable and disable the second feedback channel, whereby the first on/off valve and the second on/off valve control motion of the spool valve.

One advantage of the present invention is that a valve actuator assembly is provided for an engine that has dual hydraulic feedback for precise motion by self-regulating flow control. Another advantage of the present invention is that the valve actuator assembly has controllability that is open loop stable with automatic regulation. Yet another advantage of the present invention is that the valve actuator assembly is an enabler for improved valve train stability without sacrificing dynamic performance. Still another advantage of the present invention is that the valve actuator assembly is an enabler for improved engine performance, improved engine fuel economy by lowering fuel consumption, and improved engine emissions by lowering emissions. A further advantage of the present invention is that the valve actuator assembly minimizes energy consumption by self-regulation flow control, a simple spool valve, and efficient valve control to minimize throttling of the fluid flow. Yet a further advantage of the present invention is that the valve actuator assembly uses one solenoid, one spool valve, and two on/off valves. Still a further advantage of the present invention is that the valve actuator assembly has a relatively small size and is easy to package in an engine. Another advantage of the present invention is that the valve actuator assembly has a relatively low cost. Yet another advantage of the present invention is that the valve actuator assembly has built-in soft landing capability to reduce noise and improve durability. A further advantage of the present invention is that the valve actuator assembly provides both precise lift control and soft landing capability by using dual hydraulic feedback.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
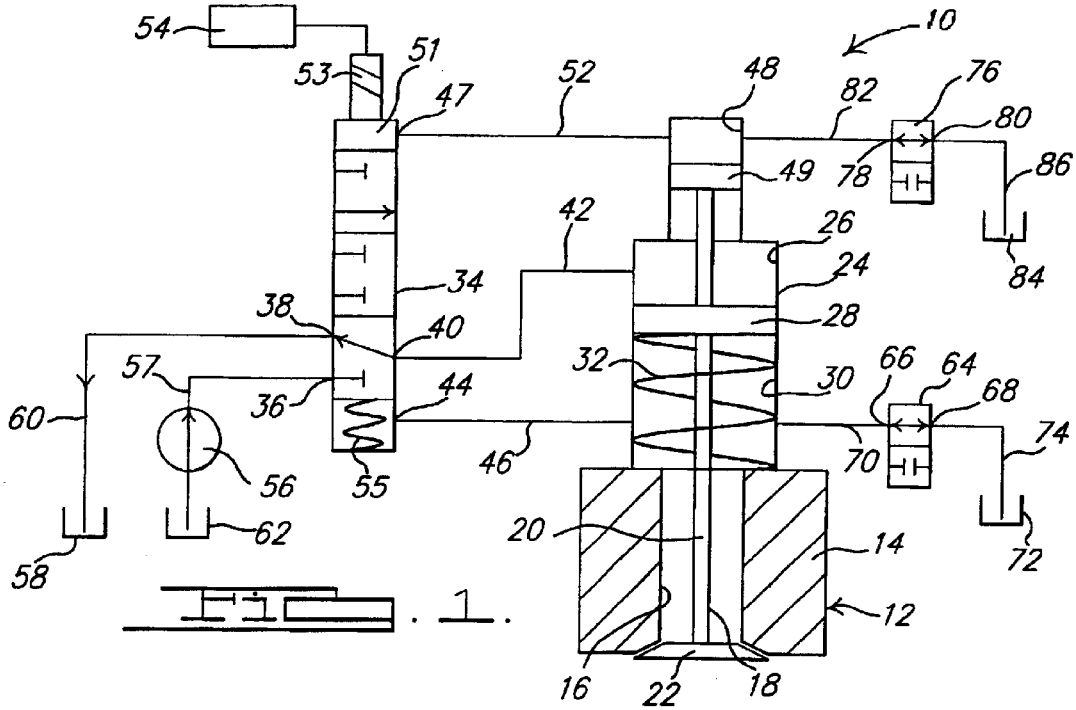
FIG. 1 is a diagrammatic view of a valve actuator assembly, according to the present invention, illustrated in operational relationship with an engine of a vehicle.
Figure 2:
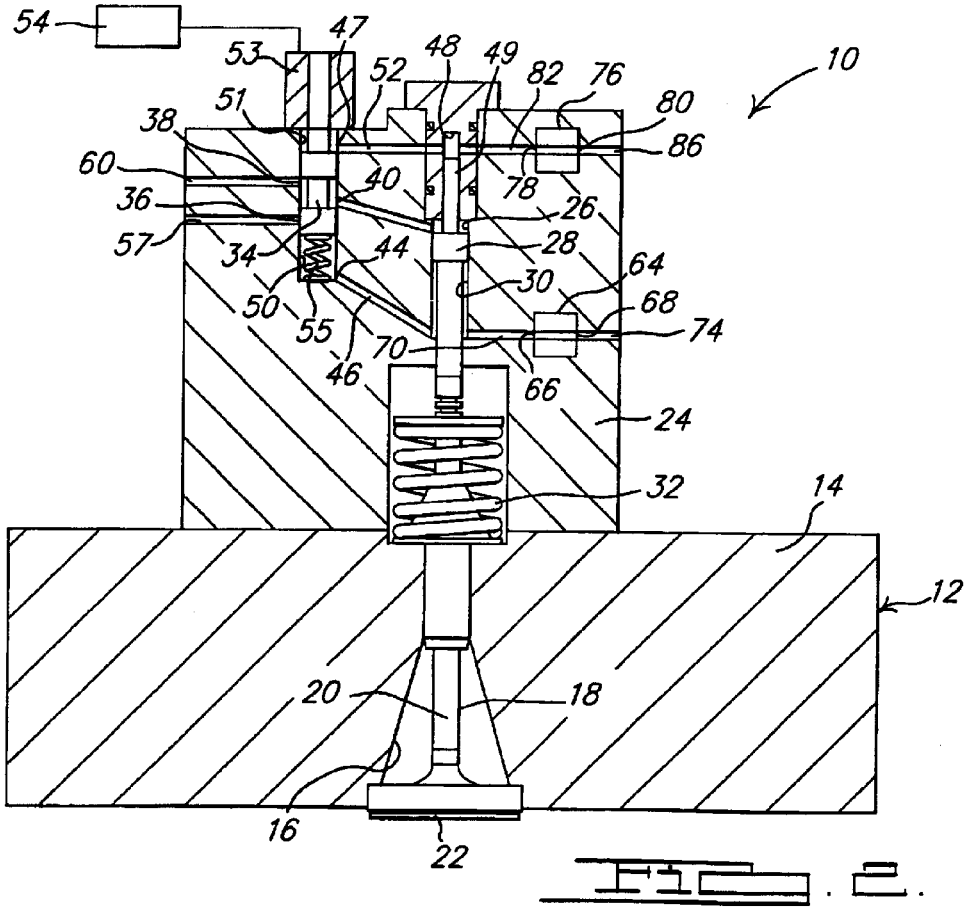
FIG. 2 is a fragmentary view of the valve actuator assembly of FIG. 1 in an engine valve closed position.
Figure 3:
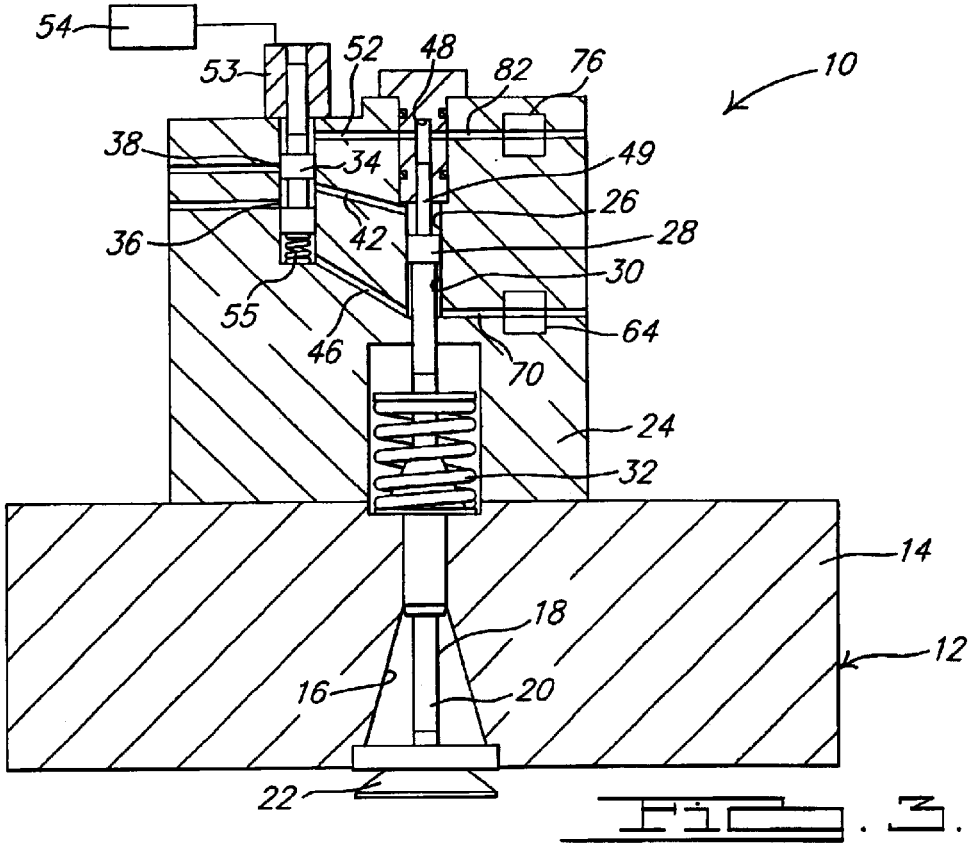
FIG. 3 is a view similar to FIG. 2 illustrating the valve actuator assembly in an engine valve opening position.
Figure 4:
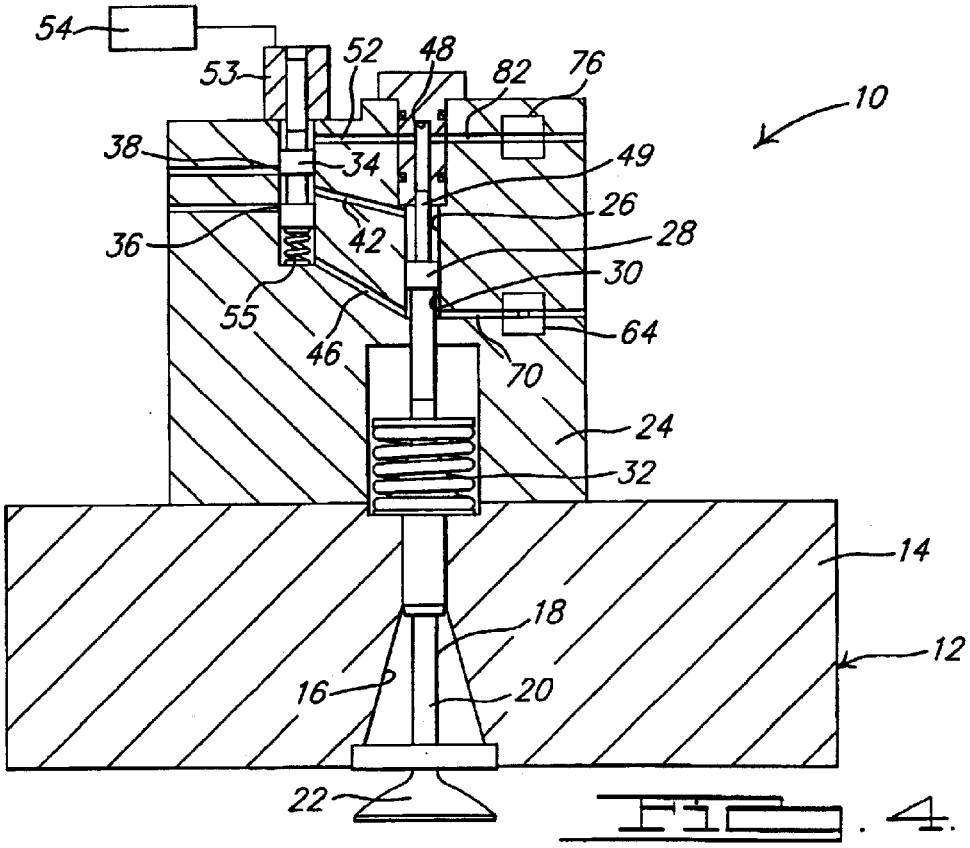
FIG. 4 is a view similar to FIG. 2 illustrating the valve actuator assembly in an engine valve open position.
Figure 5:
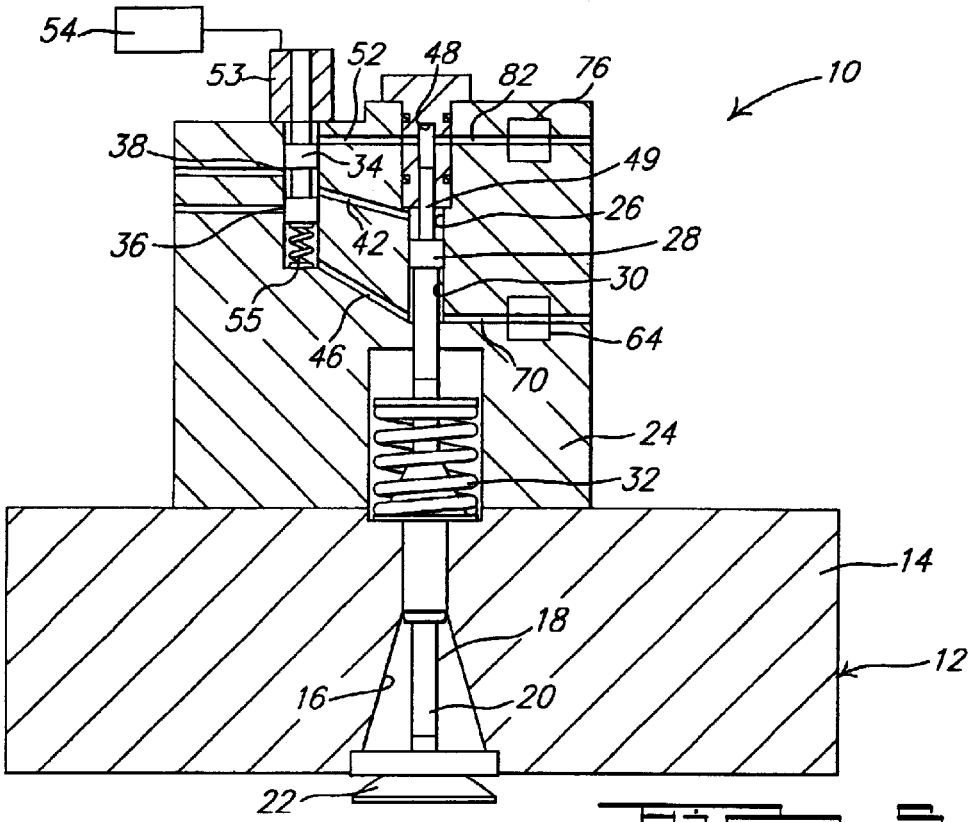
FIG. 5 is a view similar to FIG. 2 illustrating the valve actuator assembly in an engine valve returning position.
Figure 6:
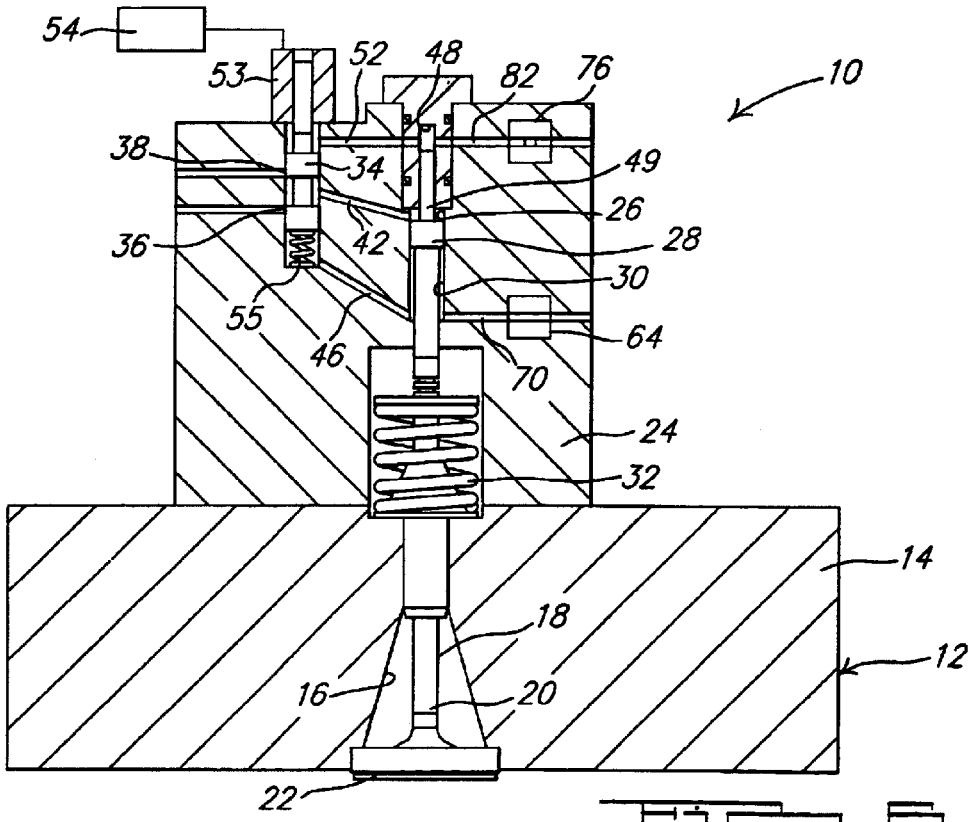
FIG. 6 is a view similar to FIG. 2 illustrating the valve actuator assembly in an engine valve seating position.

Referring to the drawings and in particular FIG. 1, one embodiment of a valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position as illustrated in FIGS. 3 through 5 and a closed position as illustrated in FIGS. 2 and 6. It should be appreciated that the engine valve 18 may be either an intake or exhaust valve. It should also be appreciated that the valve actuator assembly 10 is a camless valve train for the engine 12. It should further be appreciated that, except for the valve actuator assembly 10, the engine 12 is conventional and known in the art.

The valve actuator assembly 10 includes a valve housing 24 disposed adjacent the engine block 14. The valve housing 24 has a main or first fluid chamber 26 therein. The valve actuator assembly 10 also includes a first piston 28 connected to or in contact with the valve stem 20 of the engine valve 18. The piston 28 is disposed in the first fluid chamber 26 of the valve housing 24 and forms a second fluid chamber 30 therein. The valve actuator assembly 10 includes an engine valve spring 32 disposed about the valve stem 20 and contacting the engine block 14 to bias the engine valve 18 toward the closed position of FIG. 2. It should be appreciated that the valve head 22 closes the opening 16 when the engine valve 18 is in the closed position.

The valve actuator assembly 10 also includes a spool valve 34 fluidly connected to the first fluid chamber 26 and the second fluid chamber 30 of the valve housing 24. The spool valve 34 is of a three-position three-way type. The spool valve 34 has a high pressure port 36 and a low pressure port 38. The spool valve 34 also has a first fluid chamber port 40 fluidly connected by a driving channel 42 to the first fluid chamber 26 and a second fluid chamber port 44 fluidly connected by a first feedback channel 46 to the second fluid chamber 30. The spool valve 34 has a third fluid chamber port 47 at one end for a function to be described. It should be appreciated that the spool valve 34 controls fluid flow to the first fluid chamber 26.

The valve actuator assembly 10 includes a third fluid chamber 48 in the valve housing 24. The valve actuator assembly 10 also includes a second piston 49 connected to the first piston 28. The second piston 49 is disposed in the third fluid chamber 48 of the valve housing 24. The valve actuator assembly 10 includes a fourth fluid chamber 50 at one end of the spool valve 34 fluidly connected to the second fluid chamber port 44. The valve actuator assembly 10 includes a fifth fluid chamber 51 at one end of the spool valve 34 opposite the fourth fluid chamber 50 fluidly connected to the third fluid chamber port 47. The valve actuator assembly 10 includes a second feedback channel 52 fluidly interconnecting the fifth fluid chamber 51 and the third fluid chamber 48. It should be appreciated that the spool valve 34, fluid chambers 50,51, and channels 42,46,52 are located in the valve housing 24.

The valve actuator assembly 10 further includes an actuator 53 at the end of the spool valve 34 adjacent to the fifth fluid chamber 51. The actuator 53 is of a linear type such as a solenoid electrically connected to a source of electrical power such as a controller 54. The valve actuator assembly 10 further includes a spool valve spring 55 disposed in the fourth fluid chamber 50 to bias the spool valve 34 toward the actuator 53. It should be appreciated that the controller 54 energizes and de-energizes the actuator 53 to move the spool valve 34.

The valve actuator assembly 10 also includes a fluid pump 56 and a high pressure line 57 fluidly connected to the pump 56 and the high pressure port 36. The valve actuator assembly 10 includes a fluid tank 58 and a low pressure line 60 fluidly connected to the tank 58 and the low pressure port 38. It should be appreciated that the pump 56 may be fluidly connected to the tank 58 or a separate fluid tank 62.

The valve actuator assembly 10 further includes a first on/off valve 64 fluidly connected to the second fluid chamber 30 of the valve housing 24. The first on/off valve 64 is of a two-way magnetically latchable type and is electrically connected to a source of electrical power such as the controller 54. The first on/off valve 64 has a first port 66 and a second port 68. The first port 66 is fluidly connected by a channel 70 to the second fluid chamber 30. The valve actuator assembly 10 includes a fluid tank 72 fluidly connected to the second port 68 by a low pressure line 74. It should be appreciated that the fluid tank 72 is a low pressure source.

The valve actuator assembly 10 further includes a second on/off valve 76 fluidly connected to the third fluid chamber 48 of the valve housing 24. The second on/off valve 76 is of a two-way magnetically latchable type and is electrically connected to a source of electrical power such as the controller 54. The second on/off valve 76 has a first port 78 and a second port 80. The first port 78 is fluidly connected by a channel 82 to the third fluid chamber 48. The valve actuator assembly 10 includes a fluid tank 84 fluidly connected to the second port 80 by a low pressure line 86. It should be appreciated that the fluid tank 84 is a low pressure source. It should also be appreciated that the low pressure line 86 may be fluidly connected to the fluid tank 72 or the separate fluid tank 84.

In operation of the valve actuator assembly 10, the engine valve 18 is shown in a closed position as illustrated in FIG. 2. At the closed position of the engine valve 18, the actuator 53 is de-energized by the controller 54 so that the spool valve spring 55 pushes the spool valve 34 upward and exposes the driving channel 42 to the low pressure line 60. The first fluid chamber 26 is then connected to the low pressure line 60 through the driving channel 42. The engine valve spring 32 keeps the engine valve 18 closed with the valve head 22 closing the opening 16. The on/off valves 64 and 76 are open so that both the second fluid chamber 30 and the third fluid chamber 48 are connected or exposed to the fluid tanks 72 and 84.

To open the engine valve 18, the controller 54 energizes the actuator 53 and causes the actuator 53 to overcome the force of the spool valve spring 55 and drive the spool valve 34 downward. The driving channel 42 is then exposed to the high pressure line 57 and the high pressure fluid flows into the first fluid chamber 26, which overcomes the force from the engine valve spring 32 and pushes the engine valve 18 open. The on/off valves 64 and 76 are open so that the second fluid chamber 30 and the third fluid chamber 48 are connected or exposed to the fluid tanks 72 and 84 as illustrated in FIG. 3. It should be appreciated that, in FIG. 3, the engine valve 18 is illustrated in an engine valve opening position.

To stop the engine valve 18 at a predetermined lift position, the controller 54 energizes the first on/off valve 64 and the first on/off valve 64 is closed, cutting off the fluid connection between the second fluid chamber 30 and the fluid tank 72. As the engine valve 18 continues to move downward, the first piston 28 pushes the fluid in the second fluid chamber 30 via the first feedback channel 46 into the fourth fluid chamber 50, which drives the spool valve 34 upward. This motion continues until the spool valve 34 cuts off the fluid connection between the driving channel 42 and both the high pressure line 57 and the low pressure line 60. When the spool valve 34 reaches this equilibrium point, the engine valve 18 stops as illustrated in FIG. 4. It should be appreciated that, in FIG. 4, the engine valve 18 is illustrated with the engine valve 18 opened at the desired lift position. It should also be appreciated that the desired lift position is determined by the timing of the operation of the first on/off valve 64.

To close the engine valve 18, the controller 54 de-energizes the actuator 53. The spool valve spring 55 then pushes the spool valve 34 upward and exposes the driving channel 42 to the low pressure line 60. The high pressure fluid in the first fluid chamber 26 will exhaust into the low pressure line 60 and return to the fluid tank 58. The engine valve spring 32 drives the engine valve 18 back or upward as illustrated in FIG. 5. It should be appreciated that the on/off valves 64 and 76 are open so that the second fluid chamber 30 and third fluid chamber 48 are connected to the fluid tanks 72 and 86. It should also be appreciated that the actuator 53 may be of a push/pull type.

To stop the engine valve 18 at a predetermined lift position while the engine valve 18 is returning to the seated or closed position, the controller 54 energizes the second on/off valve 76 and the second on/off valve 76 is closed, cutting off the fluid connection between the third fluid chamber 48 and the fluid tank 84. As the engine valve 18 moves upward, it displaces the fluid from the third fluid chamber 48 into the fifth fluid chamber 51, driving the spool valve 34 downward. This motion continues until the spool valve 34 cuts off the connection between the driving channel 42 and both the low pressure line 60 and the high pressure line 57. When the spool valve 34 reaches this equilibrium point, the engine valve 18 stops as illustrated in FIG. 6. It should be appreciated that, in FIG. 6, the engine valve 18 is illustrated in an engine valve seating position. It should also be appreciated that this feature allows for better control of the impact velocity at seating ("soft landing") of the engine valve 18.

Figure 7:
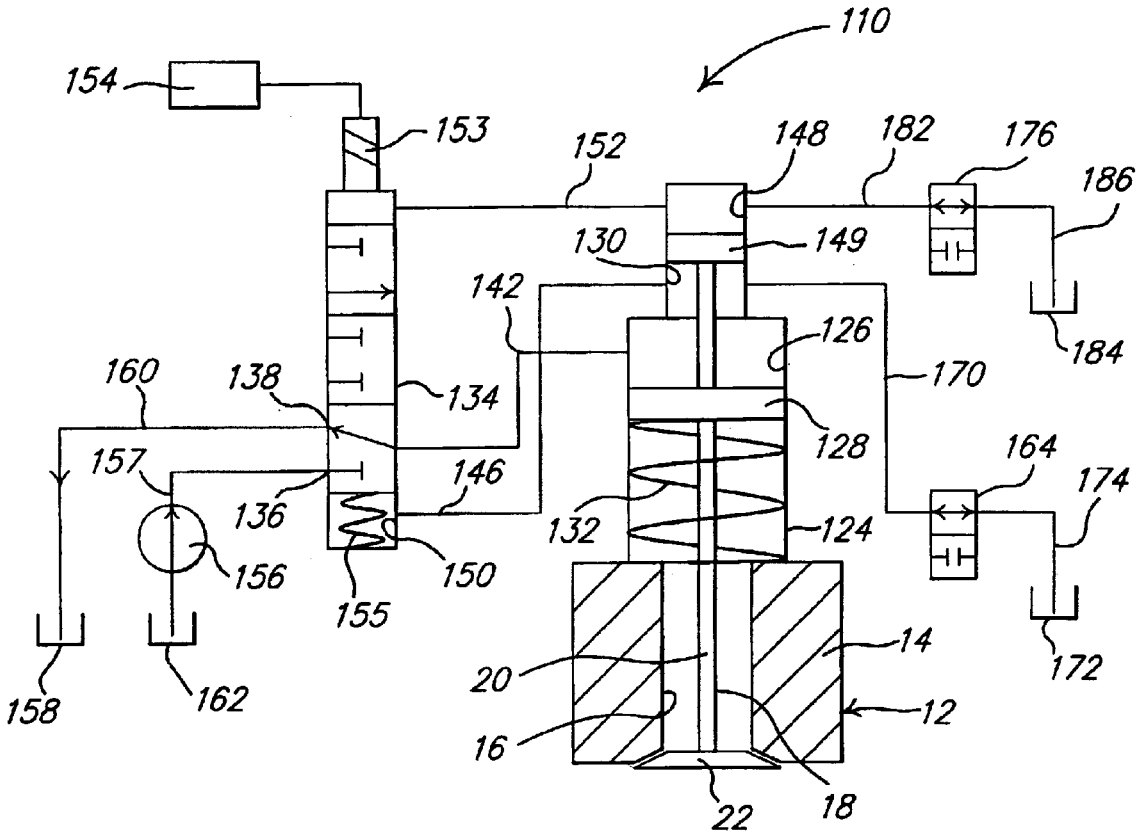
FIG. 7 is a diagrammatic view of another embodiment, according to the present invention, of the valve actuator assembly of FIG. 1.

Referring to FIG. 7, another embodiment, according to the present invention, of the valve actuator assembly 10 is shown. Like parts of the valve actuator assembly 110 have like reference numerals increased by one hundred (100). In this embodiment, the valve actuator assembly 110 includes the engine valve 18, spool valve 134, actuator 153, controller 154, first on/off valve 164, and second on/off valve 176. The second fluid chamber 130 is disposed on the other side of the second piston 149 opposite the third fluid chamber 148. The first feedback channel 146 interconnects the second fluid chamber 130 and the fourth fluid chamber 150. The channel 170 interconnects the second fluid chamber 130 and the first on/off valve 164. The operation of the valve actuator assembly 110 is similar to the valve actuator assembly 10.

The valve actuator assembly 10 of the present invention is made open-loop stable by utilizing the hydraulic feedback channels 46 and 52 and the on/off valves 64 and 76 are used to enable or disable the feedback channels 46 and 52. Open-loop stability implies that a system's response to a given input signal is not unbounded. The better controllability achieved by open loop stability enables the valve actuator assembly 10 to provide better performance. The valve actuator assembly 10 of the present invention precisely controls the motion of the spool valve 34 through the feedback channels 46 and 52 so that it avoids unnecessary throttling of the low pressure flow and high pressure flow, thereby providing energy consumption benefit.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A valve actuator assembly for an engine of a vehicle comprising:

a movable engine valve;

a movable spool valve;

a driving channel interconnecting said spool valve and said engine valve;

a first feedback channel interconnecting said spool valve and said engine valve;

a second feedback channel interconnecting said spool valve and said engine valve;

an actuator operatively cooperating with said spool valve to position said spool valve to prevent and allow fluid flow in and out of said driving channel to position said engine valve;

a first on/off valve in fluid communication with said first feedback channel to enable and disable said first feedback channel; and a second on/off valve in fluid communication with said second feedback channel to enable and disable said second feedback channel, whereby the first on/off valve and the second on/off valve control motion of the spool valve.

2. A valve actuator assembly as set forth in claim 1 including a valve housing.

3. A valve actuator assembly as set forth in claim 2 wherein said valve housing has a first fluid chamber fluidly communicating with said driving channel and a second fluid chamber fluidly communicating with said first feedback channel.

4. A valve actuator assembly as set forth in claim 3 including a first piston operatively cooperating with said engine valve and being disposed in said valve housing and having said first fluid chamber on one side and said second fluid chamber on an opposite side.

5. A valve actuator assembly as set forth in claim 3 including a first on/off valve channel interconnecting said second fluid chamber and said first on/off valve.

6. A valve actuator assembly as set forth in claim 3 wherein said valve housing has a third fluid chamber fluidly communicating with said second feedback channel.

7. A valve actuator assembly as set forth in claim 6 including a second piston operatively cooperating with said engine valve and being disposed in said valve housing and having said third fluid chamber on one side thereof.

8. A valve actuator assembly as set forth in claim 7 including a second on/off valve channel interconnecting said third fluid chamber and said second on/off valve.

9. A valve actuator assembly as set forth in claim 1 including a fourth fluid chamber at one end of said spool valve and fluidly communicating with said first feedback channel and a fifth fluid chamber at one end of said spool valve opposite said fourth fluid chamber and fluidly communicating with said second feedback channel.

10. A valve actuator assembly as set forth in claim 8 including a spool valve spring disposed in said fourth fluid chamber to bias said spool valve toward said actuator.

11. A valve actuator assembly as set forth in claim 1 wherein said actuator is of a linear type to generate linear motion.

12. A valve actuator assembly as set forth in claim 11 including a controller electrically connected to said actuator to energize and de-energize said actuator.

13. A valve actuator assembly comprising:

a movable engine valve;

a movable spool valve;

a valve, housing having a primary fluid chamber, a secondary fluid chamber, and a third fluid chamber;

a first piston operatively cooperating with said engine valve and being disposed in said valve housing and having said first fluid chamber on one side and said second fluid chamber on an opposite side;

a second piston operatively cooperating with said engine valve and being disposed in said valve housing and having said third fluid chamber on one side thereof;

a driving channel interconnecting said spool valve and said first fluid chamber;

a first feedback channel interconnecting said spool valve and said second fluid chamber;

a second feedback channel interconnecting said spool valve and said third fluid chamber;

an actuator operatively cooperating with said spool valve to position said spool valve to prevent and allow fluid flow in and out of said driving channel to position said engine valve;

a first on/off valve in fluid communication with said first feedback channel to enable and disable said first feedback channel to stop said engine valve at a predetermined lift position; and a second on/off valve in fluid communication with said second feedback channel to enable and disable said second feedback channel to stop said engine valve at a predetermined return position.

14. A valve actuator assembly as set forth in claim 13 including a first on/off valve channel interconnecting said second fluid chamber and said first on/off valve.

15. A valve actuator assembly as set forth in claim 13 wherein said valve housing has a third fluid chamber fluidly communicating with said second feedback channel.

16. A valve actuator assembly as set forth in claim 15 including a second piston operatively cooperating with said engine valve and being disposed in said valve housing and having said third fluid chamber on one side thereof.

17. A valve actuator assembly as set forth in claim 16 including a second on/off valve channel interconnecting said third fluid chamber and said second on/off valve.

18. A valve actuator assembly as set forth in claim 13 including a fourth fluid chamber at one end of said spool valve and fluidly communicating with said first feedback channel and a fifth fluid chamber at one end of said spool valve opposite said fourth fluid chamber and fluidly communicating with said second feedback channel.

19. A valve actuator assembly as set forth in claim 18 including a spool valve spring disposed in said fourth fluid chamber to bias said spool valve toward said actuator.

20. A valve actuator assembly as set forth in claim 13 wherein said actuator is of a linear type to generate linear motion.

21. A valve actuator assembly as set forth in claim 20 including a controller electrically connected to said actuator to energize and de-energize said actuator.

22. A method of operating a valve actuator assembly for a vehicle comprising:

providing a movable engine valve;

providing a movable spool valve;

actuating an actuator operatively cooperating with the spool valve and supplying a driving channel interconnecting the spool valve and the engine valve with high pressure fluid to move open the engine valve;

supplying a first feedback channel interconnecting the spool valve and the engine valve with fluid flow;

supplying a second feedback channel interconnecting the spool valve and the engine valve with fluid flow;

enabling and disenabling the first feedback channel via a first on/off valve and enabling and disenabling the second feedback channel via a second on/off valve and controlling motion of the spool valve.

* * * * *